United States Patent [19]

Trent

[11] 4,224,713

[45] Sep. 30, 1980

[54] APPLICATOR FOR PAINTS AND THE LIKE

[76] Inventor: Marilyn Y. Trent, P.O. Box 5, Clayton, Calif. 94517

[21] Appl. No.: 2,655

[22] Filed: Jan. 11, 1979

[51] Int. Cl.[3] ..... B05C 1/06

[52] U.S. Cl. ..... 15/210 R; 15/231; 15/235.4

[58] Field of Search ..... 15/143 R, 143 B, 144 R, 15/144 A, 144 B, 145, 160, 172, 176, 209 R, 210 R, 219, 231–233, 244 R, 235.4, 235.8, 244 A, 245, 209

[56] References Cited

U.S. PATENT DOCUMENTS

| | | | |
|---|---|---|---|
| 1,755,881 | 4/1930 | Kilbride | 15/232 |
| 2,665,446 | 1/1954 | Gregory | 15/145 X |
| 2,753,579 | 7/1956 | Kussmann | 15/160 X |
| 3,877,103 | 4/1975 | Nash | 15/231 |

FOREIGN PATENT DOCUMENTS

| | | | |
|---|---|---|---|
| 222744 | 10/1924 | United Kingdom | 15/231 |

*Primary Examiner*—Edward L. Roberts
*Attorney, Agent, or Firm*—Bruce H. Johnsonbaugh

[57] ABSTRACT

An applicator for applying paints, cleaners and the like to walls with limited surface clearance provided. An offset handle is connected to a thin, flat backing plate which, in turn, carries a cover. The cover is wetted with paint or cleaner to be applied to walls with limited surface clearance such as behind toilets and water heaters.

1 Claim, 5 Drawing Figures

APPLICATOR FOR PAINTS AND THE LIKE

This invention relates generally to applicators for paints and cleaners and more specifically to an applicator for use on walls with limited surface clearance. In painting or cleaning walls with limited surface clearance, such as wall sections behind toilets, water heaters, and appliances, either the appliance or other obstruction must be removed or a generally unsatisfactory application is made to the wall behind it. The present invention is intended to alleviate that problem.

Accordingly, a primary object of the present invention is to provide a device for applying materials to walls with limited surface clearance.

A further object of the invention is to provide an applicator easy of manufacture and simple in construction to apply materials to wall sections behind appliances and fixtures, such as toilets and water heaters.

Further objects and advantages will become apparent from the following description and the drawings, wherein.

Figure 1:
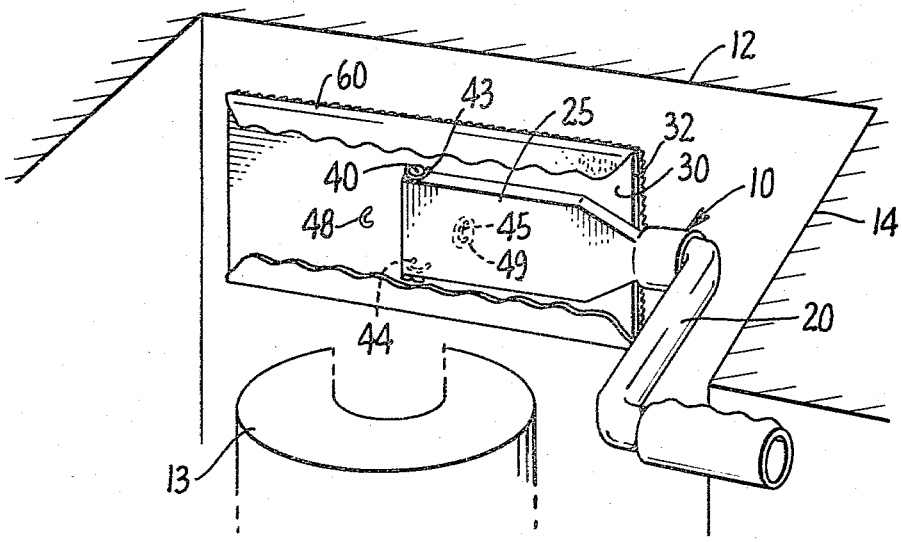
FIG. 1 is a perspective view of the invention.

FIG. 1 shows the device generally as 10 as used to apply materials to a wall 12 with limited surface clearance caused by the presence of a water heater 13. Wall 14 perpendicular to wall 12 further restricts access to the portion of wall 12 behind water heater 13.

An offset handle 20 is connected to a thin, flat backing plate 30. Connecting means 40 joins the handle 20 to backing plate 30. Cover means 60 is removably carried by backing plate 30.

Figure 2:
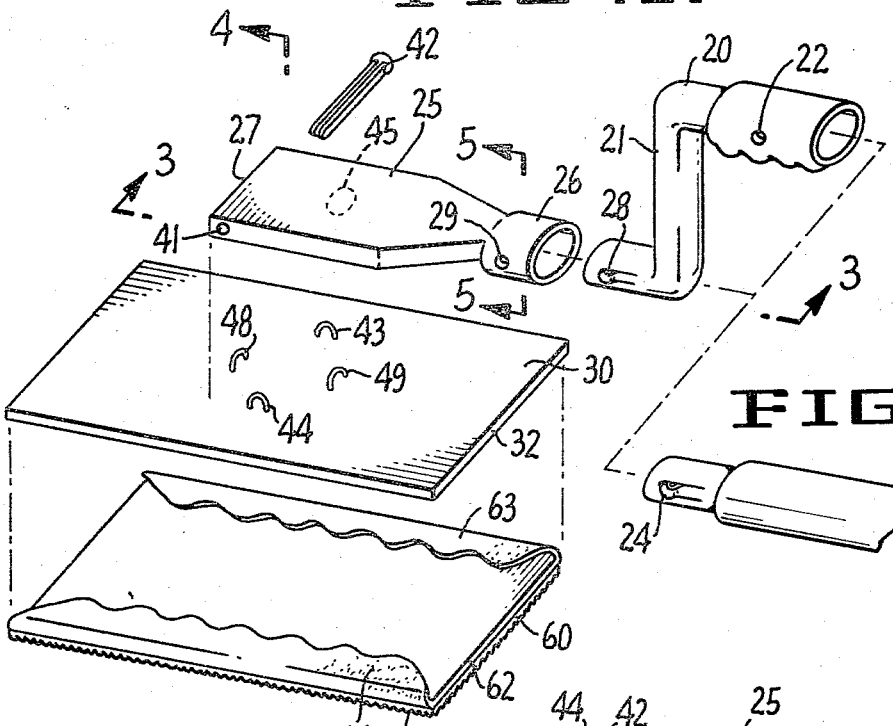
FIG. 2 is an exploded view of the invention.
Figure 3:
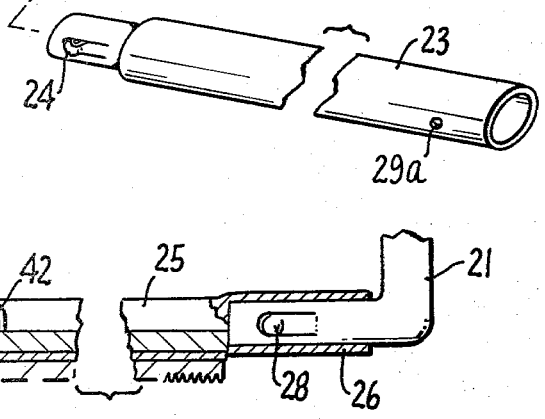
FIG. 3 is a sectional view along the lines 3—3 of FIG. 2.

FIG. 2 shows the components in greater detail. Offset handle 20 has a Z-shaped portion 21 of elliptical cross section which has a recess 22 for receiving a cylindrical extension 23 with a resilient tab 24 for engaging recess 22 or tailpiece 26 described below. Offset handle 20 clears wall 14.

Handle 20 has an adaptor 25 of generally flat configuration with an elliptical tailpiece 26 that connects to the Z-shaped section 21 by tab 28 on the Z-shaped section 21 and recess 29 in the tailpiece 26. Adaptor 25 lies flat against backing plate 30 as shown in FIG. 1 with the tailpiece 26 clearing the right edge 32 of backing plate 30, to lower the profile of the overall applicator. The overall thickness of the applicator is less than one inch, and the thickness of tailpiece 26 is also less than one inch.

The distal end 27 of adaptor 25 has a hole 41 extending therethrough which receives pin 42. Pin 42 extends through grommets 43 and 44 which are carried by backing plate 30. As shown in FIG. 2, connecting means 40 comprises pin 42, the hole 41 formed in the distal end of handle 20, and grommets 43 and 44 on backing plate 30. Grommets 48 and 49 are carried by backing plate 30 and are used if it is desired to rotate the backing plate 30 90° from the position shown in the drawings. Adaptor 25 has a recess 45 formed therein to clear grommet 49.

Backing plate 30, as shown in FIG. 2, is a thin, flat plate of rigid material.

Figure 4:
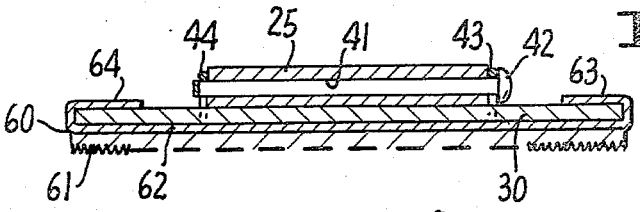
FIG. 4 is a sectional view along the line 4—4 of FIG. 2.
Figure 5:
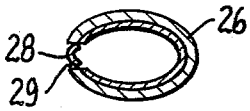
FIG. 5 is a sectional view along the line 5—5 of FIG. 2.

Cover means 60 has a cover 61 of absorbent material carried by a backing means 62 which may be made of metal or plastic. Cover means 60 is intended to be disposable. Backing means 62 has flaps 63 and 64 which are intended to wrap around the edges of backing plate 30 as shown in FIG. 4. Cover means 60 slides over backing plate 30 with flaps 63 and 64 gripping the sides of backing plate 30.

As shown in FIG. 2, when extension 23 is inserted into tailpiece 26, handle 20 is inserted into extension 23, with recess **29*a* in extension 23 receiving tab 28 of handle 20**.

What is claimed is:

1. A device for applying materials to walls with limited surface clearance comprising:

a Z-shaped handle with a thin, flat adaptor at its distal end, a thin, flat, generally rectangular backing plate, two pairs of grommets carried by said backing plate, said adaptor having a hole extending through its distal end, and pin means removably extending through a pair of said grommets and said hole to connect said adaptor to said backing plate such that said flat adaptor rotates about said pin means and may lie against said backing plate to reduce the overall thickness of the device to a minimum, and such that said pin means may be removed from one pair of grommets, said backing plate may be rotated and said pin means may be inserted into said second pair of grommets to change the size of the path covered by said backing plate.

* * * * *